US005871020A

United States Patent [19]

DeVone

[11] Patent Number: 5,871,020

[45] Date of Patent: Feb. 16, 1999

[54] APPLICATION FOR MEDICINAL THERAPEUTIC PHARMACEUTICAL AND COSMETIC PREPARATION

[75] Inventor: Adam R. DeVone, Laguna Niguel, Calif.

[73] Assignee: Handsfree Applicators, Inc., Irvine, Calif.

[21] Appl. No.: 861,948

[22] Filed: May 22, 1997

[51] Int. Cl.[6] ..... A45D 40/26

[52] U.S. Cl. ..... 132/317; 401/207; 401/262; 220/256

[58] Field of Search ..... 132/317, 320, 132/74.5, 73; 401/302, 205, 207, 262; 215/355, 364, 320; 220/256, 229, 367.1, 369, 373

[56] References Cited

U.S. PATENT DOCUMENTS

| | | | |
|---|---|---|---|
| 1,581,563 | 4/1926 | Brown | 401/262 |
| 1,949,976 | 3/1934 | Runnels | 401/202 |
| 3,135,007 | 6/1964 | Howell | 401/262 |
| 3,756,732 | 9/1973 | Stoffler | 401/202 |
| 4,446,965 | 5/1984 | Montiel | 206/205 |
| 4,964,372 | 10/1990 | Zeenni et al. | 132/74.5 |
| 5,054,503 | 10/1991 | Keller | 132/74.5 |
| 5,649,859 | 7/1997 | Shiga | 220/367.1 |

FOREIGN PATENT DOCUMENTS

| | | | |
|---|---|---|---|
| 551938 | 11/1956 | Belgium | 401/202 |
| 1814434 | 6/1970 | Germany | 401/262 |
| 3938347 | 5/1991 | Germany | 401/205 |
| 602402 | 2/1960 | Italy | 401/262 |
| 6805429 | 10/1969 | Netherlands | 220/256 |
| 742615 | 12/1955 | United Kingdom | 401/202 |
| 857968 | 1/1961 | United Kingdom | 401/207 |

*Primary Examiner*—Todd E. Manahan
*Assistant Examiner*—Eduardo C. Robert
*Attorney, Agent, or Firm*—William G. Lane

[57] ABSTRACT

An improved applicator for medicinal, therapeutic, pharmaceutical, and/or cosmetic preparations comprising an applicator head having a foam applicator head, a flexible tubular reservoir for storing the preparation, and a cap to seal off the applicator end of the applicator head. The foam having one or more slits which form communication passageways between the reservoir and the applicator head and which are compressed by the cap to prevent migration of air from the exterior into the reservoir and passage of preparation from the reservoir to the applicator head when the cap is seated on the applicator head.

20 Claims, 4 Drawing Sheets

APPLICATION FOR MEDICINAL THERAPEUTIC PHARMACEUTICAL AND COSMETIC PREPARATION

SCOPE OF THE INVENTION

The present invention is directed to an applicator for applying medicinal, pharmaceutical, therapeutic and cosmetic preparations and compositions to the skin.

BACKGROUND OF THE INVENTION

The application of many medicinal, pharmaceutical, therapeutic, and cosmetic preparations to the skin can be unpleasant, awkward, or messy because of the constituents in the preparations and compositions (collectively "preparations" herein). In an attempt to overcome this problem with respect to suntan lotion, Solar Gear, Inc. of Newport Beach, Calif., developed an applicator comprising a plastic tube sealed at one end with its other end attached to a shoulder element. The tube functions as a reservoir for the suntan lotion. Opposite the tube end of the shoulder element, the shoulder element has a foam head for applying the suntan lotion to the skin. The shoulder has an internal transverse wall separating the foam applicator head from the reservoir. A hollow tube extends upwardly from the transverse wall close to the top of the foam applicator head. The tube is in fluid communication with the reservoir and top of the applicator head. A cap fits over the top section of the shoulder. Within the cap, extending downwardly from the center is a shaft. When the cap is placed on the shoulder element, the shaft enters the hollow tube to seal the tube and minimize leakage of the preparation through the tube.

Although the applicator has been successful, it has not proven to be a foolproof sealed system. When pressure is applied to the reservoir, which is a flexible plastic tube, the preparation material, suntan lotion, is forced up in the tube into the space between the shaft and the tube to pool on the top surface of the applicator head. When the cap is removed, the preparation frequently drips at the head and frequently permits excess suntan lotion to spill on clothing or the bathing suit. Suntan lotion can stain fabric.

A second shortcoming of the applicator is the fact that when the cap is removed, the tube is opened, permitting air to enter into the reservoir. The air is an oxidant source for the preparation and can shorten the shelf life and the sunscreening properties of the suntan lotion.

It is an object of the present invention to provide an improved applicator head having a foam application head separated from the reservoir with means for transporting preparation from the reservoir to the applicator head for application to the skin. It is a further object of the present invention to provide a valve system for preventing the flow of the preparation from the reservoir to the applicator head when the applicator is attached.

It is still a further object of the present invention to provide an improved applicator for preparations having a valve system which will prevent the entrance of air into the reservoir when the applicator cap is removed and/or when the preparation from the reservoir is transported to the applicator head.

SUMMARY OF THE INVENTION

The present invention is directed to an improved applicator head comprising a hollow applicator head shell and foam applicator head. The shell has a central cavity, a perimeter wall surrounding the central cavity, an open applicator end, an opposite open reservoir end communicating with the central cavity, and a transverse wall within the shell separating the central cavity into an applicator chamber opening into the open application end and a reservoir chamber opening into the open reservoir end. The transverse wall has at least one opening between the application chamber and the reservoir chamber. The foam applicator pad has an applicator surface, an applicator portion, an opposite base surface, and a base portion. The applicator portion is positioned within the applicator chamber with the applicator surface extending beyond the open application end of the shell. At least a portion of the base surface of the foam applicator head is affixed to the transverse wall to secure the head thereon. The foam applicator pad has at least one slit extending from the applicator surface to the base surface; at least a portion of each slit at the base surface positioned on an opening in the transverse wall to permit the passage of preparation from the reservoir chamber to the applicator surface through the slits. The foam applicator head is secured to the transverse wall by an adhesive or heat weld.

Another embodiment of the present invention is directed to the combination of the improved application head with an improved applicator head. The improved applicator head cap has a perimeter wall, a top transverse wall, a closed top end, and an open bottom end, the top transverse wall sealing off the top end in combination with the perimeter wall. The open end is adapted to receive the applicator end of the shell in a female to male relationship. The cap has means to compress the applicator portion of the foam applicator head to compress the same and to compress the slits and to seal the slits to prevent passage of preparation from the reservoir chamber to the applicator surface and the passage of air into the reservoir chamber.

In one embodiment of the invention, the foam applicator pad has a single longitudinal slit. In another embodiment of the present invention, the foam applicator pad has two or more slits which centrally intersect each other, centering each slit to form a cross, star or the like patterns. In a preferred embodiment of the present invention, the foam applicator head has two longitudinal slits which centrally cross each other to form a cross or an X.

In one embodiment of the present invention, the longitudinal length of each slit remains constant from the applicator surface through the foam applicator head to the base surface of the foam. In another embodiment of the present invention, the longitudinal length of each slit from the applicator surface through the applicator head to the base surface decreases. The length can decrease to the size of the opening in the transverse wall of the applicator head shell.

In one embodiment of the present invention, the transverse wall has one opening and a portion of at least each slit at the base surface is positioned at the opening. In another embodiment of the present invention, the transverse wall has a plurality of openings and at least a portion of each slit is positioned over at least one of such openings. In another embodiment of the present invention, the transverse wall has a plurality of openings and one or more slits, and at least a portion of each slit at the base surface is positioned at two or more openings.

In another embodiment of the present invention, the transverse wall has a hollow shaft extending upwardly from the transverse wall to an elevation below the applicator surface of the foam applicator head, the shaft being hollow and adapted to receive a mating shaft or male-to-female mating relationship mounted in the cap for the improved applicator head to seal the hollow shaft. The slits in combination with the hollow shaft valve and mating shaft act as a stop valve to prevent the passage of air and preparation through the hollow shaft when the cap is attached to the applicator head.

In another embodiment of the present invention, the improved applicator for medicinal, pharmaceutical, therapeutic and cosmetic preparations comprises a hollow applicator head with a shell having a central cavity, a perimeter wall surrounding the central cavity, an open applicator end, and an opposite open reservoir end and a transverse wall within the shell separating the central cavity into an applicator chamber communicating with the open applicator end and the reservoir chamber communicating with the open reservoir end, said transverse wall having at least one opening between the applicator chamber and the reservoir chamber. The applicator has a foam applicator head having an applicator surface and an opposite base surface, an applicator portion and a base portion, the base portion of the foam applicator head positioned in the applicator chamber with the applicator surface extending beyond the open applicator end, at least a portion of the base surface affixed to the transverse wall to secure the foam applicator head in the applicator chamber. The applicator head has at least one slit extending from the applicator surface through the foam to the base surface, at least a portion of each slit in the base surface positioned over one of said openings in the transverse wall. The applicator has an applicator head cap with a perimeter wall, a top transverse wall, a closed top end and an open bottom end, the top transverse wall together with the outer perimeter wall sealing off the top end of the cap, the open bottom end of the cap adapted to receive and seat on the application end of the shell of the improved applicator head, the cap having means to compress the applicator portion of the foam applicator head to compress the walls of the slits together and seal the slits. The applicator has a flexible tubular reservoir member is provided for holding medicinal, pharmaceutical, therapeutic, and/or cosmetic preparations and compositions, the remote end of the tubular member being sealed off, the near end of the tubular member adapted to receive the open reservoir end of the applicator head and to be secured thereto in a sealed relationship.

DETAILED DESCRIPTION OF THE INVENTION

Figure 1:
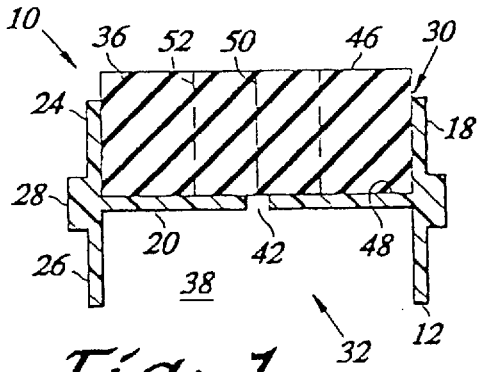
FIG. 1 is a side cross-sectional view of the improved applicator head of the present invention.
Figure 3:
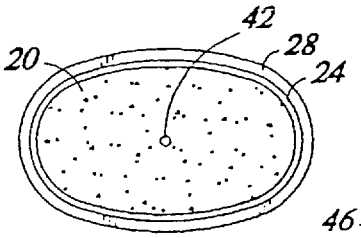
FIG. 3 is a top view of the shell of the improved applicator head of FIG. 1.
Figure 6:
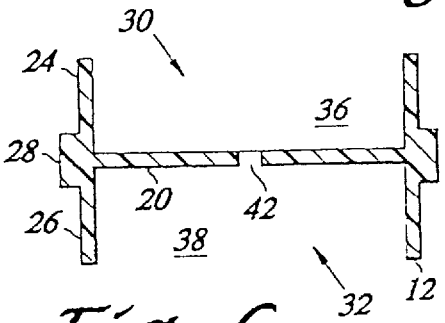
FIG. 6 is a side cross-sectional view of the applicator head shell of FIGS. 1–5.

Referring to FIG. 1, the improved applicator head 10 of the present invention comprises a shell 12 with a foam applicator head 14. Shell 12 has a perimeter wall 18 and a transverse wall 20 inside the shell extending from the inner sides of the perimeter wall completely across the shell (see FIG. 3). The perimeter wall has an upper wall portion 24, a lower wall portion 26, and a shoulder 28. A flexible polymeric tubular reservoir 100 (see FIG. 23) is sealed to the outer side of the lower wall portion 26. The upper wall portion 24 is adapted to receive a cap 60 to seal off the applicator head (see FIGS. 15–20 and 23). The shell has an open applicator end 30 and an opposite open reservoir end 32. The transverse wall 20 divides the inner space of the shell into an application chamber 36 and a reservoir chamber 38 (see FIG. 6). The transverse wall has an opening 42 in fluid communication with the application chamber and reservoir chamber.

The foam application head or pad 14 is positioned within the application chamber 36. The upper or applicator portion 44*a* of the foam application head extends beyond the open applicator end 30 of the shell. The foam application head has an application surface 46 and a base surface 48. The lower or base portion 44B of the foam applicator head is located in the applicator chamber. Preferably at least a portion of the base surface is secured to the transverse wall to the limit line 52, which will be described below, by adhesive, heat weld, cement or two-sided adhesive tape or film.

Figure 4:
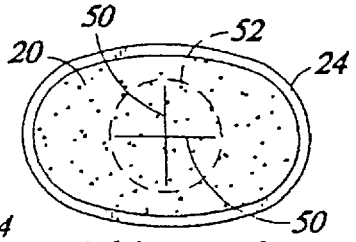
FIG. 4 is a top view of the foam applicator head of FIG. 1.

The foam application head has two longitudinal slits cut through the foam application head from the application surface down to the base surface. The slits are cuts, not grooves, through the foam. They are not channels through the foam when the foam is in a resting state, as shown in FIGS. 1 and 4. In the resting state, the walls of the slit are closed together. The foam, because of its compressive property, keeps the slit walls 50 together preventing medicinal, pharmaceutical, therapeutic, or cosmetic preparation in the reservoir chamber 38 from seeping through opening 42 to the applicator surface 46. Similarly, the compressive force of the foam keeps the walls of each slit 50 together to prevent air from diffusing from the exterior into the reservoir 38 through the slits and through the opening 42.

Figure 2:
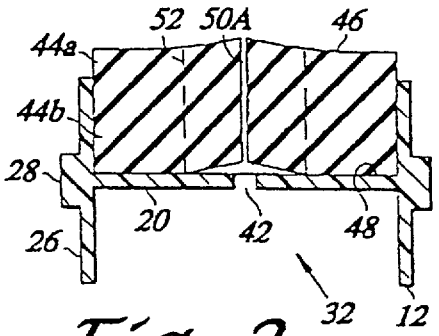
FIG. 2 is a side cross-sectional view similar to that of FIG. 1 showing compression of the foam applicator head during passage of preparation.
Figure 5:
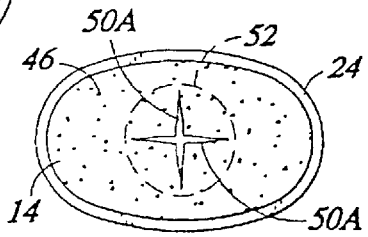
FIG. 5 is a top view of the foam applicator head of FIG. 2.
Figure 23:
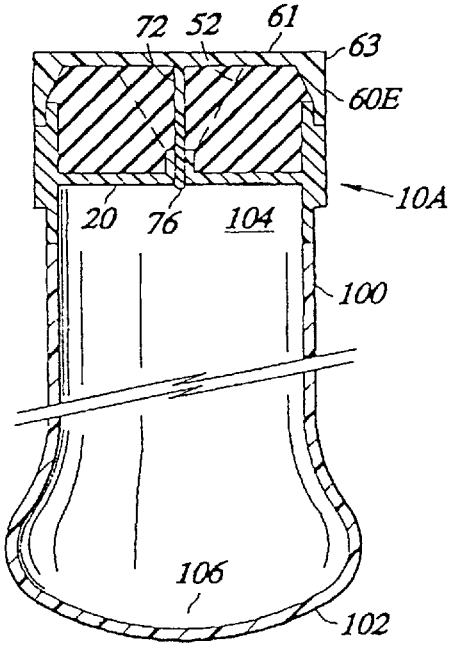
FIG. 23 is a side cross-sectional view of the improved applicator of the present invention.

As shown in FIG. 23, the reservoir 100 is preferably a flexible polymeric tube or container having a sealed bottom end 102. The flexible reservoir is preferably made from tubing having an open near end 104 which is secured to the lower wall portion 26 of the shell 12. The other or far open end of the tubing 106 is closed off by sealing the opposite walls of the tubing together either with cement or heat treatment. When the flexible reservoir 100 is squeezed or compressed, preparation in the reservoir is forced through opening 42 into the slits 50 which forces the slits' walls apart compressing the foam, as shown in FIG. 2 and FIG. 5, to permit the preparation to move from the reservoir chamber to the applicator surface 46 between the walls of the slits which forms a passageway when the preparation is forced through the opening 42. The foam in the vicinity of the slits must have the ability to move and be compressed to separate the walls of each slit, and accordingly, the base surface 48 of the foam applicator head around the opening and optionally to the ends of the slits, the limit line 52, is not secured or affixed to the transverse wall. This permits the foam to move upwardly and the slit walls to separate, as shown in FIG. 2, to permit the foam between the slits to be compressed to allow the space or channel 50A between the split walls to form to permit the passage of preparation from the reservoir to the applicator surface.

Figure 7:
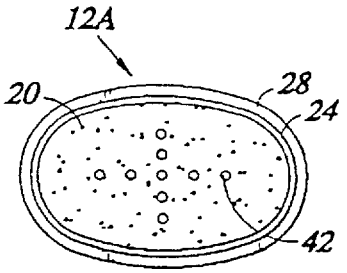
FIG. 7 is a top view of the shell of another embodiment of the present invention.

Referring to FIG. 7, in an alternative embodiment, the shell 12A has a plurality of openings 42 rather than a single opening as shown in FIGS. 1–3 and 4. The slits 50 in the foam applicator head would be positioned over the openings 42 in shell 12A. In all other respects, shell 12A is identical to shell 12.

Figure 8:
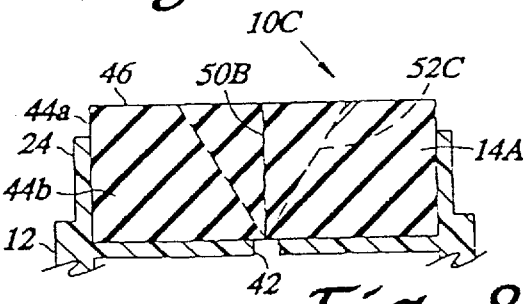
FIG. 8 is a side cross-sectional view of another embodiment of the foam applicator head of the present invention.
Figure 9:
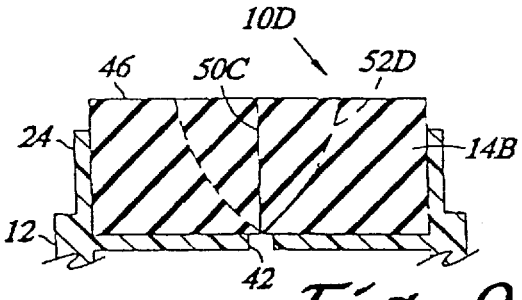
FIG. 9 is a side cross-sectional view of another embodiment of the foam applicator head of the present invention.
Figure 10:
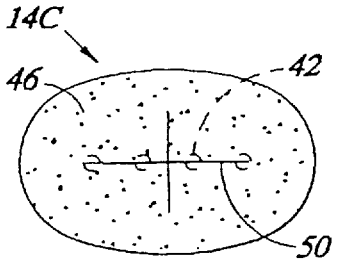
FIG. 10 is a top view of another embodiment of the foam applicator head of the present invention.
Figure 11:
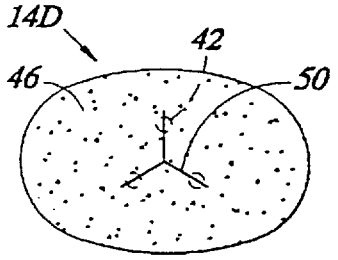
FIG. 11 is a top view of another embodiment of the foam applicator head of the present invention.
Figure 12:
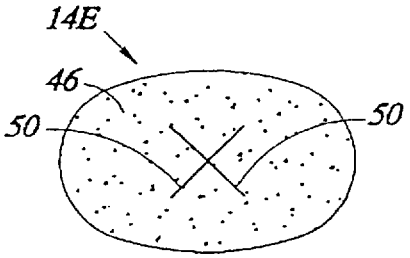
FIG. 12 is a top view of another embodiment of the foam applicator head of the present invention.
Figure 13:
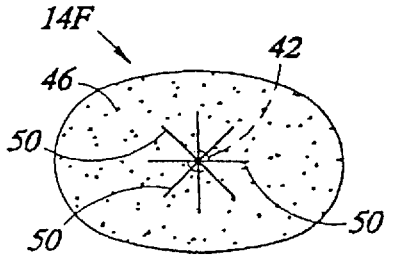
FIG. 13 is a top view of another embodiment of the foam applicator head of the present invention.
Figure 14:
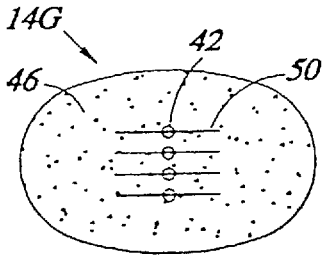
FIG. 14 is a top view of another embodiment of the foam applicator head of the present invention.

Referring to FIGS. 8 and 9, the foam applicator heads 14A and 14B, respectively, have modified slits. These heads have two longitudinal slits which are positioned perpendicular to each other to form a cross in the same manner as the head 14 as shown in FIG. 4. However, the slits in FIGS. 1–5 have longitudinal lengths that are unchanging the entire depth of the foam applicator head from the applicator surface 46 to the base surface 48. In contrast, the slits 50B and 50C in FIGS. 8 and 9 have longitudinal lengths which decrease in length from the applicator surface to the base surface of the head as shown by limit lines 52C and 52D. The slits have sufficient longitudinal length at the opening 42 to bridge the opening and permit the foam over the opening to be compressed to open the slits to permit the passage of preparation from the reservoir into the space between the walls of the slit as described above.

Referring to FIGS. 10–14, the foam applicator heads 14C through 14G have different slit arrangements or patterns when viewed from the top. The foam applicator head 14C has a single longitudinal slit 50 which can be positioned over a single opening (not shown) or a series of openings along a longitudinal line (shown in phantom). Foam applicator head 14D has three longitudinal slits 50 which meet at a common intersection to form a tri-star. Each slit can be positioned over separate openings (shown in phantom), or the tri-star can be centered over a single opening (not shown). Foam applicator head 14E has two longitudinal slits positioned perpendicular to each other and centered upon each other to form an X. This is similar to the configuration shown in FIG. 4 with the slit being rotated 45°. Foam applicator head 14F has four longitudinal slits 50; each slit intersecting the other slits at a common central point. Each slit can be positioned along its own opening (not shown) or all the slits can be positioned over a single opening at the central intersection (shown in phantom). Foam applicator head 14G has four parallel slits 50, each slit being positioned over a separate opening 42 (shown in phantom).

Referring to FIGS. 15–19, the improved applicator head is sealed off with a cap 60–60D to prevent preparation from seeping up from the reservoir to the applicator surface and air from diffusing down into the reservoir. Preparation on the applicator surface can soil clothing and the like. The caps also protects the foam applicator head from dirt.

Cap 60 has a beveled inner wall 61 which compresses the foam of the foam applicator head 14 laterally when the cap is placed on the improved applicator head. The lateral compression of the foam laterally compresses the walls of the slits together in the applicator portion to seal off any slit passageway between the reservoir chamber and the applicator surface 46.

Cap 60A has a central step 62 which extends downwardly from the inner side of the top transverse wall to the interior of the cap which compresses the foam of the foam applicator head 14 longitudinally downward towards the transverse wall. This compression of the foam further compresses the walls of the slits together, further sealing off the slits as a passageway for preparation from the reservoir when the cap is seated on the applicator head.

Cap 60B has an annular bead 64 located on its inner side of the top transverse wall to which forms a ring seal with the applicator surface 46. When the cap is seated on the applicator head, the annular bead compresses the applicator surface 46, compressing the foam to form a seal which prevents the passage of preparation from the slits between the inner side of the cap and the applicator surface 46.

Cap 60C has an angular dome 66 on the inner side of the top transverse wall 70 of the cap which compresses the applicator surface 46 longitudinally downward when the cap is seated on the applicator head, compressing the foam in the head 14, which compresses the walls of the slits together to form a seal to prevent the passage of air into the reservoir and the passage of preparation from the reservoir to the applicator surface as described above.

Cap 60D has a curved dome 68 on the inner side of the top transverse wall 70 of the caps and functions in the same manner as the angular dome 66 of cap 60C described above.

The limit line 52 shown in FIGS. 1, 2, 4, 5, 8, 9, and 15–19 shows the transverse or longitudinal length of the slit with respect to the foam applicator head.

Figure 15:
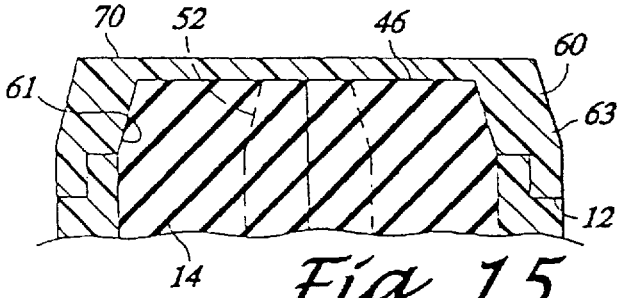
FIG. 15 is a partial side cross-sectional view of an improved applicator head closed with an improved cap of the present invention.
Figure 16:
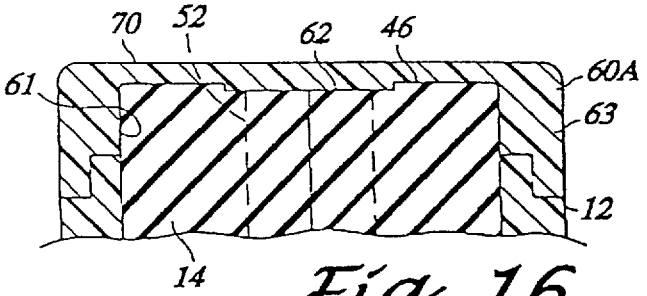
FIG. 16 is a partial side cross-sectional view of an improved applicator head closed with an improved cap of the present invention.
Figure 17:
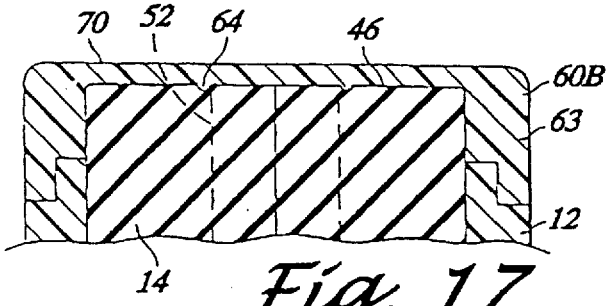
FIG. 17 is a partial side cross-sectional view of an improved applicator head closed with an improved cap of the present invention.
Figure 18:
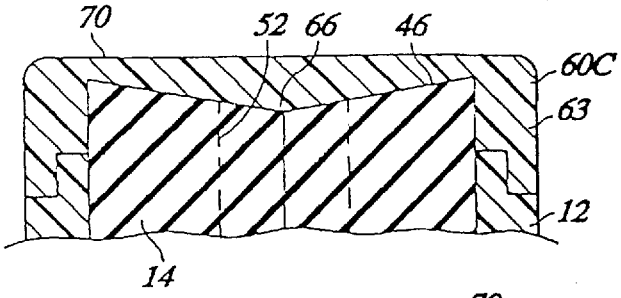
FIG. 18 is a partial side cross-sectional view of an improved applicator head closed with an improved cap of the present invention.
Figure 19:
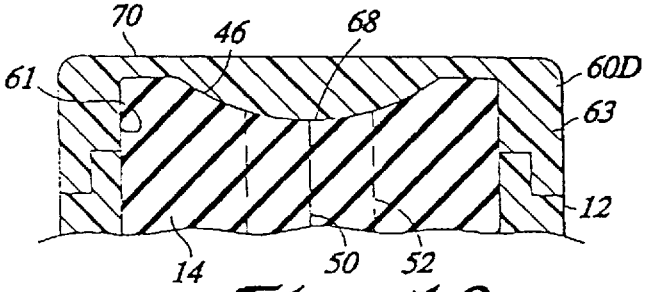
FIG. 19 is a partial side cross-sectional view of an improved applicator head closed with an improved cap of the present invention.
Figure 20:
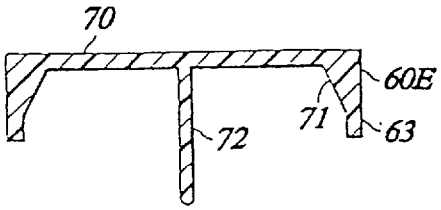
FIG. 20 is a side cross-sectional view of an improved cap for the applicator head of the present invention.
Figure 21:
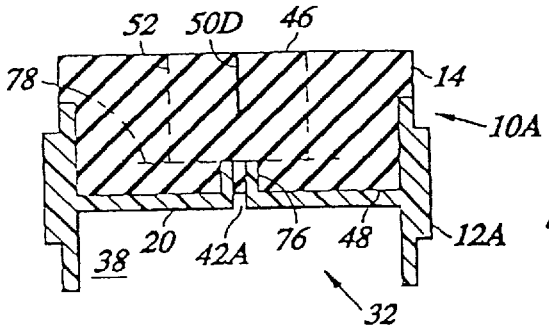
FIG. 21 is a side cross-sectional view of another embodiment of the improved applicator head of the present invention.

Referring to FIGS. 20, 21, and 23, the cap 60E has a transverse top wall 70, a perimeter side wall 63, an inner bevel wall 71 which compresses the foam of the foam applicator head in a manner similar to that shown by cap 60 in FIG. 15. Extending down from the center of the transverse top wall from the inner side is a shaft 72. This cap fits on applicator head 10*a* which is identical to applicator 10 except for the hollow nozzle 76 through which the opening 42 extends and the modification of the slits 50D in the foam applicator head 14H wherein the longitudinal slits 50D only extend through the foam from the application 46 down to the elevation 78 of the nozzle 76, not to the base surface. However, in other embodiments the slits can extend down to the base surface.

As shown in FIG. 23, when the cap is placed on the applicator head, the shaft 72 penetrates the foam applicator head 14H through slits 50D into the opening 42 of nozzle 76. The mating of shaft 72 with nozzle 76 secures the cap to the applicator head and functions as a valve means for minimizing the passage of preparation from the reservoir through the opening 42A and the slits 50D onto the applicator surface 46 when the cap is seated on the applicator head. The shaft 72 also helps compress the foam of the foam applicator head which, in turn, forces the walls of the slits together to form a tighter seal of the slits to prevent the passage of preparation out of opening 42 to the applicator surface 46 and the passage of air from outside through the slits into the reservoir. In the embodiment shown, cap 60E has an interior beveled side wall 71 which compresses the foam of the foam applicator head laterally as described above with respect to the applicator head of FIG. 15.

Figure 22:
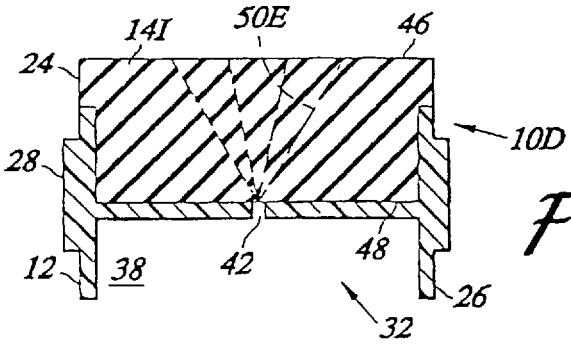
FIG. 22 is a side cross-sectional view of another embodiment of the foam applicator head of the present invention.

FIG. 22 shows an alternative embodiment of the applicator head of the present invention. Shell 12 of the applicator head 10 is identical to the shell shown in FIG. 6. The foam applicator head 14I has four parallel slits 50E. The slits angle downwardly from the applicator surface 46 to the base surface 48 to terminate at the base surface 48 over the opening 42. The slits 50 shown in the above applicator head have been perpendicular to the transverse wall. This applicator head can be closed with caps 60 through 60D described above.

The invention has been illustrated with a head and cap having an oval or round configuration when viewed from the top and bottom. The configuration of the applicator head and cap from a top view can be round, square, rectangular, ellipsoidal or the like. The oval shape has been illustrated in most of the figures with top views because that is the shape which is intended to be manufactured. However, for lip balm, a round shape (top view) would probably be used. The flexible tube 100 of the reservoir is attached to the lower wall portion 26 of the shell 12 with adhesives or by heat treatment known in the art. The cap and the head are preferably detachably secured to one another with small embosses or ring indentations about upper wall 24 (not shown) on the inner wall of the cap and corresponding indentations (not shown) in the outer wall of the upper wall portion 24 of the shell or vice versa. Optionally, in the embodiment illustrated in FIGS. 20, 21, and 23, the shaft can have embossed areas or rings at its tip portion which engage indentations or ring grooves (not shown) in the opening 42 of the nozzle 76 or vice versa to help secure the cap to the applicator head.

Figure 24:
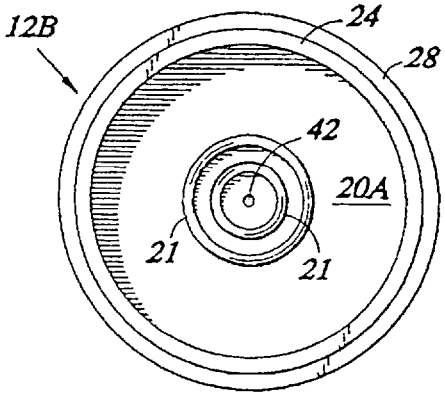
FIG. 24 is a top view of the shell of another embodiment of the improved applicator head of the present invention.
Figure 26:
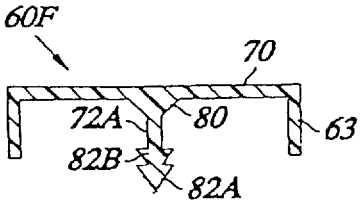
FIG. 26 is a side cross-sectional view of another embodiment of the improved cap for the improved applicator head of the present invention.
Figure 25:
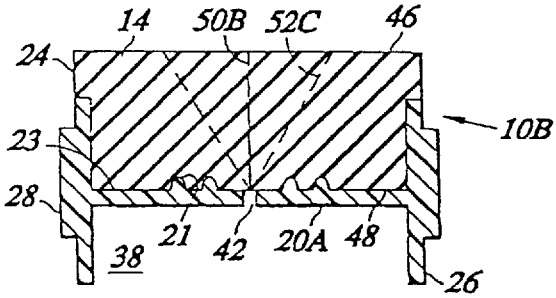
FIG. 25 is a side cross-sectional view of another embodiment of the improved applicator head of the present invention.

Referring to FIGS. 24 through 26, in this embodiment of the improved applicator head, the shell 12B has a series of annular beads or ridges 21 which together with the base surface 48 of the foam applicator head 14 form a labyrinth seal. The labyrinth seal prevents or at least minimizes the profusion of preparation from the reservoir chamber 38 through the opening 42 between the base surface 48 and the top surface 23 of the transverse wall 28. This embodiment is used when there is concern that the preparation material will attack or weaken the adhesive cement or two-sided adhesive film that secures the base surface 48 to the top surface 23 of the transverse wall 20A. In order to further prevent migration of preparation along the base surface, the longitudinal length of the slit 50B decreases progressively from the applicator surface 46 to the base surface 48, as shown by limit lines 52C, to the width of opening 42.

Cap 60F can be employed for the improved applicator head 10B. Cap 60F has a central shaft extending downwardly from the inner surface of the top transverse wall 70. The base 80 of the shaft 72A has a conical cross-section. The walls of the base 80 cap is seated on the improved applicator head apply a radial compressive force to the applicator portion of the foam applicator head to compress the walls of the slits together to further seal the slits. In addition, the bottom tip of the shaft 72A has a conical cross-section. In this particular embodiment, the shaft has two conical sections 82A and 82B. When these conical sections are inserted into the foam applicator head, they compress the foam radially outwardly to help further seal the slits by compressing the foam. Cap 60F is not limited to the improved applicator head 10B. It can also be used for the applicator head 10, 10A, and 10B as described above with respect to FIGS. 1 through 6, 8, 9, and 21.

The applicator head can be used for a variety of liquid, gel, semi-solid preparations and compositions, including medicinal, pharmaceutical, therapeutic, and cosmetic preparations such as skin creams, dermal compositions, lip balm, muscle ointments, external analegisics, sunscreen compositions, insect repellents, moisturizing compositions, skin shading or coloring compositions and the like.

The foam applicator head 14 can be prepared from a variety of foam materials. For applicator heads intended for the application of preparations and compositions to humans and animals, the foam will be a medicinal and cosmetically acceptable foam. When the foam applicator is used for applying materials to other surfaces, the foam merely has to be compatible with the preparation or composition. Preferably, the foam is a closed cell foam so that it does not become saturated with the composition or preparation. Preferably, the composition or preparation will only sit on the applicator surface 46 and will not penetrate into the foam.

The present invention has been illustrated with specific examples. However, the invention is not limited to the specific embodiments shown. The concept of the invention is to seal off the reservoir from the applicator surface by employing a slit valve means in the foam applicator head which, when compressed by the closure of the cap and/or the insertion of a shaft, compresses the walls of a slit together to form a seal which prevents the passage of preparation from the reservoir and air into the reservoir.

I claim:

1. An improved applicator head comprising a hollow applicator head shell having a central cavity, a perimeter wall surrounding the central cavity, an open applicator end and an opposite reservoir end communicating with the central cavity, and a transverse wall within the shell separating the central cavity into an applicator chamber opening into the open application end, and a reservoir chamber opening into the open reservoir end, the transverse wall having at least one opening between the applicator chamber and the reservoir chamber;

a foam applicator head having an applicator surface and an opposite base surface, the foam applicator head positioned in the applicator chamber with the applicator surface extending beyond the open applicator end, at least a portion of the base surface affixed to the transverse wall to secure the foam applicator head, the foam applicator head having at least one slit having a width extending from the applicator surface through the foam to the base surface, at least a portion of each slit at the base surface positioned on one of said openings in the transverse wall; the walls of each slit normally compressed together to seal each slit.

2. The improved applicator head according to claim 1 wherein the foam applicator head has one slit.

3. The improved applicator head of claim 1 wherein the foam applicator head has two or more slits.

4. The improved applicator head of claim 1 wherein the foam applicator head has two slits crossing each other at their central regions to form a cross configuration in a top view.

5. The improved applicator head according to claim 1 wherein the width of at least one slit from the applicator surface through the foam to the base surface remains constant.

6. The improved applicator head according to claim 1 wherein the width of at least one slit from the applicator surface through the foam to the base surface decreases.

7. The improved applicator head according to claim 1 wherein the transverse wall has one opening.

8. The improved applicator head according to claim 1 wherein the transverse wall includes a hollow shaft extending upwardly from the transverse wall towards the applicator surface, the elevation of the hollow shaft not extending to the applicator surface, the hollow shaft constituting at least one opening of the transverse wall.

9. The improved applicator head according to claim 1 wherein each slit is positioned at the base surface over two or more openings.

10. An improved applicator head comprising a hollow applicator head shell having a central cavity, a perimeter wall surrounding the central cavity, an open applicator end and an opposite reservoir end communicating with the central cavity, and a transverse wall within the shell separating the central cavity into an applicator chamber opening into the open application end, and a reservoir chamber opening into the open reservoir end, the transverse wall having at least one opening between the applicator chamber and the reservoir chamber;

a foam applicator head having an applicator surface, an opposite base surface, an application portion, and a base portion, the base portion of the foam applicator head positioned in the applicator chamber with the applicator portion extending beyond the open applicator end, at least a portion of the base surface affixed to the transverse wall to secure the foam applicator head, the applicator head having at least one slit extending from the applicator surface through the foam to the base surface, at least a portion of each slit at the base surface positioned over one of said openings in the transverse wall; the walls of each slit normally compressed together to seal each slit and an applicator head cap having a perimeter wall with an inner side, a top transverse wall with an inner side, a closed top end and an open bottom end, the top transverse wall sealing off the top end of the cap with the perimeter wall, the open bottom end of the cap adapted to receive and seat on the application end of the improved applicator head, the cap having means to compress the applicator portion of the foam applicator head to compress the walls of at least one slit together and seal the said at least one slit.

11. The improved applicator head according to claim 10 wherein the inner side of the perimeter wall of the cap is beveled inwardly towards the top transverse wall and adapted to laterally compress the applicator portion of the foam applicator head when the cap is seated on the improved applicator head to further compress the walls of at least one slit together and seal said slit.

12. The improved applicator head according to claim 10 wherein the inner side of the top transverse wall of the cap has a step platform extending towards the open bottom end of the cap adapted to compress the applicator surface of the foam applicator head longitudinally downward to compress the applicator surface and a portion of the applicator portion of the foam applicator head to further compress the walls of each slit together to seal each slit when the cap is seated on said head.

13. The improved applicator head according to claim 10 wherein the inner side of the top transverse wall of the cap has at least one annular bead extending downwardly from the interior side towards the open end of the cap and which is adapted to compress the applicator surface of the foam applicator head and a portion of the applicator portion of said head with an annular compression zone to prevent migration of air and preparation between the inner side of the cap and the applicator surface of the foam applicator head when the cap is seated on said head.

14. The improved applicator head of claim 10 wherein the inner side of the top transverse wall of the cap has a dome portion extending downwardly towards the open end of the cap and which is adapted to compress the applicator surface and at least a portion of the applicator portion of the foam applicator head to compress the walls of at least one slit together to further compress the walls and seal said slit when the cap is seated on said head.

15. The improved applicator head according to claim 10 wherein the applicator head has a hollow shaft having a bore extending upwardly from the transverse wall towards the applicator surface, the hollow shaft not extending to the applicator surface, the bore of the hollow shaft constituting at least one opening in the transverse wall, and the cap has a shaft extending downwardly from the inner side of the top transverse wall beyond the bottom open end of the cap, the shaft of the cap adapted to enter the bore of the hollow shaft alone when the cap is seated on the applicator head to seal off the bore of the hollow shaft.

16. An improved applicator for medicinal, pharmaceutical, therapeutic and cosmetic preparations comprising a hollow applicator head with a shell having a central cavity, a perimeter wall with an inner side surrounding the central cavity, an open applicator end, and an opposite open reservoir end and a transverse wall within the shell separating the central cavity into an applicator chamber communicating with the open applicator end and the reservoir chamber communicating with the open reservoir end, said transverse wall having at least one opening between the applicator chamber and the reservoir chamber;

a foam applicator head having an applicator surface and an opposite base surface, an applicator portion and a base portion, the base portion of the foam applicator head positioned in the applicator chamber with the applicator portion extending beyond the open applicator end, at least a portion of the base surface affixed to the transverse wall to secure the foam applicator head in the applicator chamber, the foam applicator head having at least one slit extending from the applicator surface through the foam to the base surface, at least a portion of at least one slit in the base surface positioned over at least one of said openings in the transverse wall the walls of each slit normally compressed together to seal each slit;

an applicator head cap having a perimeter wall, a top transverse wall with an inner side, a closed top end and an open bottom end, the top transverse wall together with the outer perimeter wall sealing off the top end of the cap, the open bottom end of the cap adapted to receive and seat on the application end of the shell of the improved applicator head, the cap having means to compress the applicator portion of the foam applicator head to compress the walls of at least one slit together to further compress and seal the at least one slit; and a flexible tubular reservoir member for holding medicinal, pharmaceutical, therapeutic, and/or cosmetic preparations and compositions having a near end and opposite remote end, the remote end of the tubular member being sealed off, the near end of the tubular member adapted to receive the open reservoir end of the applicator head and to be secured thereto in a sealed relationship.

17. The improved applicator head according to claim 16 wherein the foam applicator head has two slits transversely crossing each other at a 90° angle in their central region to form a cross pattern from a top view.

18. The improved applicator according to claim 17 wherein the transverse wall has one opening.

19. The improved applicator according to claim 16 wherein the inner side of the perimeter wall of the cap has means to laterally compress the applicator portion of the foam applicator head when the cap is seated on the applicator head to further compress and seal the walls of at least one slit together.

20. The improved applicator head according to claim 16 wherein the applicator head has a hollow shaft having a bore extending upwardly from the transverse wall towards the open applicator end of the shell, the bore of the hollow shaft constituting at least one opening in the transverse wall, the cap having a shaft extending downwardly from the inner side of the top transverse wall beyond the bottom open end of the cap, the shaft of the cap adapted to enter the bore of the hollow shaft alone in a male-female relationship when the cap is seated on the applicator head to seal off the bore of the hollow shaft.

* * * * *

UNITED STATES PATENT AND TRADEMARK OFFICE

CERTIFICATE OF CORRRECTION

PATENT NO. : 5,871,020
DATED : February 16, 1999
INVENTOR(S) : Adam R. De Vone

It is certified that error appears in the above-identified patent and that said Letters Patent is hereby corrected as shown below:

On the title page, insert the following:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 3 | 3 | 5 | 6 | 4 | 4 | 1 | Dec. 5, 1967 | Schwartzman | | | |
| | | 3 | 2 | 2 | 6 | 7 | 6 | 2 | Jan. 4, 1966 | Norman | | | |
| | | | | | | | | | | | | | |

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | 8 | 7 | 0 | 8 | 5 | 9 | 7 | | Aug. 06, 1987 | DE | | | | |
| | 6 | 1 | 8 | 6 | 5 | 0 | | | Feb. 24, 1949 | GB | | | | |
| | 4 | 9 | 7 | 4 | 6 | 4 | | | Dec. 20, 1938 | GB | | | | |
| | | | | | | | | | | | | | | |
| | | | | | | | | | | | | | | |
| | | | | | | | | | | | | | | |
| | | | | | | | | | | | | | | |
| | | | | | | | | | | | | | | |

Signed and Sealed this

Twenty-sixth Day of October, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,871,020

DATED : Feb. 16, 1999

INVENTOR(S) : Adam R. DeVone

It is certified that error appears in the above-identified patent and that said Letters Patent is hereby corrected as shown below:

On title page, item [54] and col. 1, line 1,

In the title, delete the first word "APPLICATION" and insert the word "APPLICATOR"

Signed and Sealed this

Twenty-first Day of March, 2000

*Attest:*

*Attesting Officer*

Q. TODD DICKINSON

*Commissioner of Patents and Trademarks*